US005177310A

United States Patent [19]

Davies

[11] Patent Number: 5,177,310

[45] Date of Patent: Jan. 5, 1993

[54] ACOUSTIC DEVICE

[76] Inventor: Maurice P. Davies, 57 Orchard Way, London Road, Ashford, Middlesex, England, TW15 3AU

[21] Appl. No.: 610,140

[22] Filed: Nov. 7, 1990

[30] Foreign Application Priority Data

Nov. 9, 1989 [GB] United Kingdom ..... 8925317

[51] Int. Cl.[5] ..... G10D 13/08

[52] U.S. Cl. ..... 84/404

[58] Field of Search ..... 84/102, 103, 402–440; 116/148, 169, 171; 446/418, 421, 422; D17/22

[56] References Cited

U.S. PATENT DOCUMENTS 4,599,932 7/1986 Malta ..... 84/404

*Primary Examiner*—L. T. Hix

*Assistant Examiner*—Howard B. Blankenship

[57] ABSTRACT

An acoustic device (10) in the form of a musical instrument comprises a metal plate (11) having opposite rectilinear edges converging towards a handle portion (15) to which is secured a handle (12) there being secured to the handle (12) by means of a connecting member (26) of resilient material a clapper (13). When the handle is grasped, a quick movement of the wrist will effect striking of the plate (11) by a ball (28) of the clapper (13) and the plate (11) will resonate.

8 Claims, 2 Drawing Sheets

Figure 3:
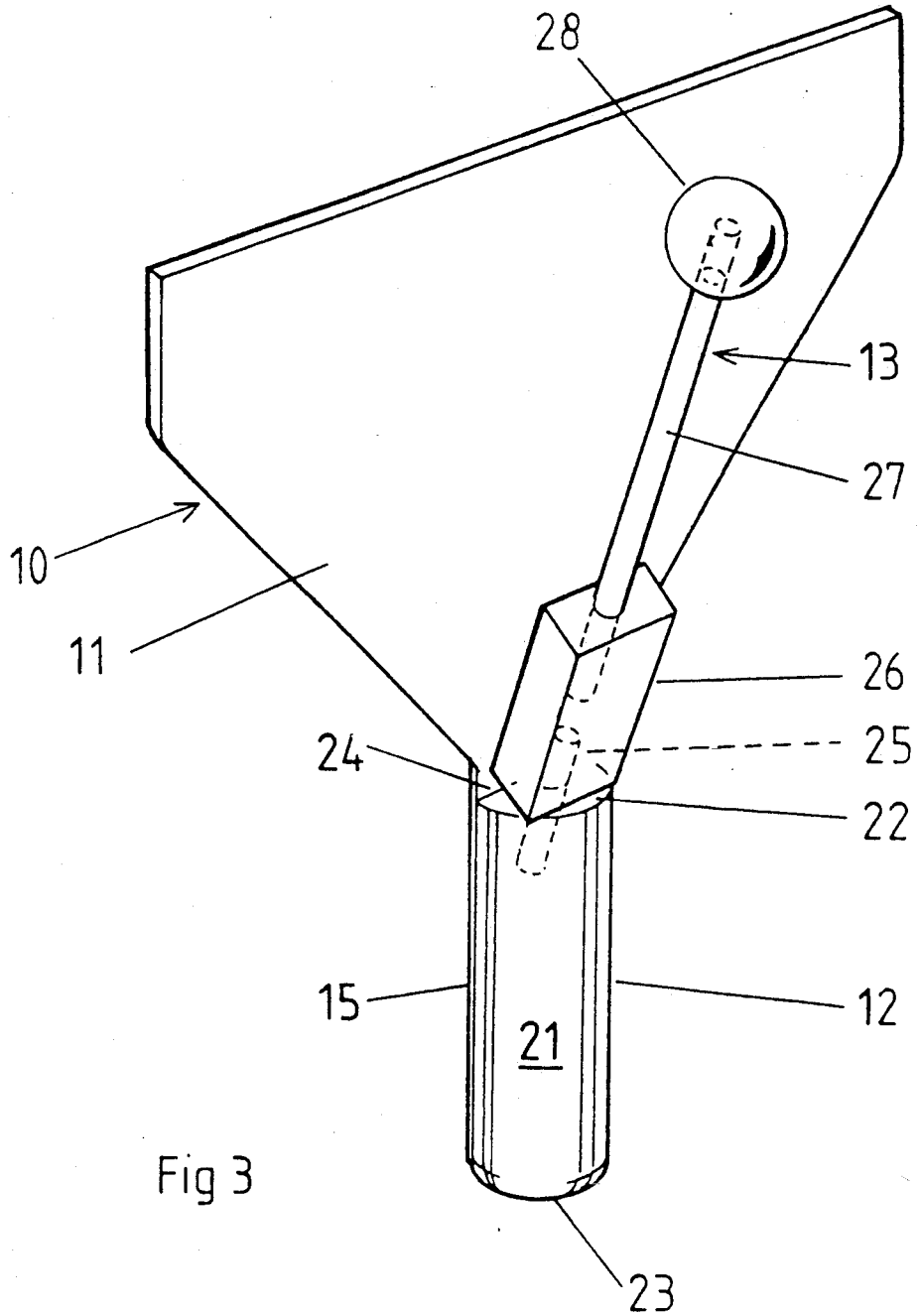

Fig 2
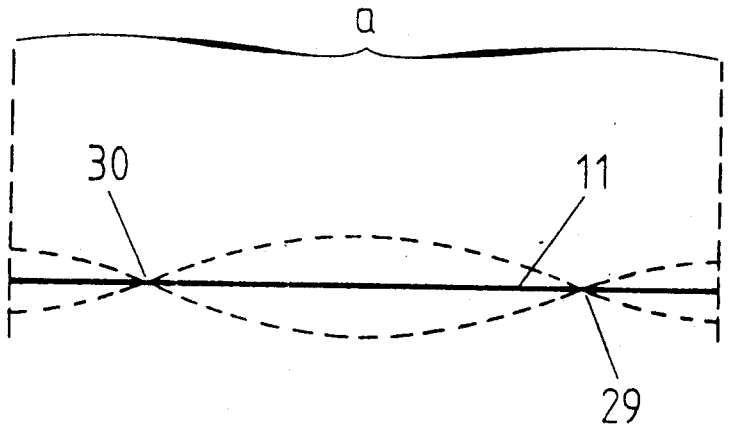
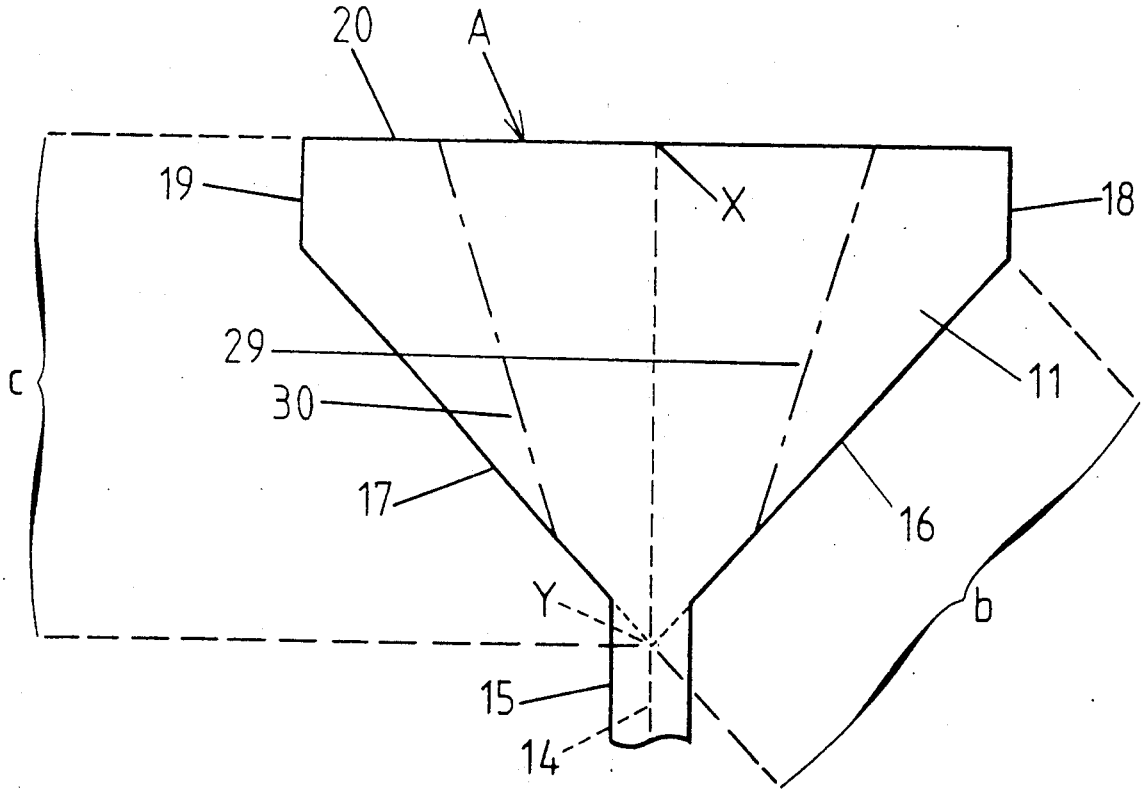
Fig 1

ACOUSTIC DEVICE

This invention relates to an acoustic device and particularly, but not exclusively, to an acoustic device for use as a percussive musical instrument.

It is common practice in schools to introduce pupils to music by providing the pupils with percussive instruments and organising the pupils into groups such as to perform with the instruments as an orchestra. An instrument which is particularly well suited for such occasions is a hand bell. This is because a hand bell is easy to operate and it is possible in a relatively short time to organise an orchestra of performers playing hand bells of different pitch.

Unfortunately, hand bells are generally expensive to manufacture and, in consequence, schools do not have funds necessary to provide orchestras of hand bells.

It is desireable, therefore, to provide an acoustic device which can be operated as easily as a hand bell and which, when operated produces a sound of comparable quality and duration to a hand bell and yet which is less expensive to manufacture than a hand bell.

According to the present invention, there is provided an acoustic device comprising a metal plate having a first location and a configuration expanding outwardly from the first location in a direction on opposite sides of a first axis extending through the first location, the configuration providing two diverging rectilinear edges of substantially equal length, each said length being a first dimension, and two substantially parallel rectilinear edges of substantially equal length remote from the first location, the substantially parallel edges being spaced one from another at a distance, being a second dimension, along a second axis at right angles to the first axis and crossing the first axis at a second location spaced a distance, being a third dimension, from the first location, wherein the first and third dimensions are within a ratio of 0.75:1 and 1.25:1 and the first and second dimensions are within a ratio of 0.75:1 and 2.5:1 such that, when the plate is supported at least as far from the second location as the first location and is subjected to a stimulus, the plate resonates.

A preferred set of ratios of first, second and third dimensions is 132:186:123. It has been found that such a set of ratios provides optimum resonance with a shape that gives a pair of nodal lines which somewhat approximates to that of an outline of a similarly sized bell.

Following is a description, by way of example only and with reference to the accompanying drawing, of one method of carrying the invention into effect.

In the drawing:

FIG. 1 is a plan view of one embodiment of a plate of an acoustic device in accordance with the present invention, FIG. 2 is a diagrammatic view in the direction of the arrow A in FIG. 1 indicating how the plate changes shape in cross section when resonating, and FIG. 3 is a perspective view of an embodiment of an acoustic device in accordance with the present invention which incorporates the plate shown in FIG. 1.

Referring to the drawing, there is shown an acoustic device 10 comprising a plate 11, a handle 12 and a clapper 13.

The plate 11 is of metal, such as aluminum or an alloy thereof, of uniform thickness in the range 1 mm to 5 mm. A central longitudinal axis 14 of the plate 11 coincides with a central longitudinal axis of a rectangular portion 15 thereof and the configuration of the plate is such that an area bounded by diverging edges 16, 17 expands symetrically outwardly from the portion 15 in a direction on opposite sides of the axis 14 and continues in a rectangular area bounded by two parallel rectilinear short edges 18, 19 of equal length and a long edge 20 extending at right angles to the short edges 18, 19. The long edge 20 intercepts the axis 14 at X. The diverging edges 16, 17 extend at an angle the apex Y of which lies on the axis 14.

The dimensions of the plate 11 are such that the length "a" of the long edge 20, the length "b" of each of the diverging edges 16, 17 and the distance "c" along the axis 14 from the point X to the point Y are in the ratio 186:132:123.

The handle 12 comprises one or two elongate portions (one of which is shown at 21) of semi-circular transverse cross section having opposite end walls 22, 23 and a flat base 24. The bases 24 of the portions 21 are united by means, such as adhesive or screws, to opposite facing surfaces of the rectangular portion 15 of the plate 11. An end wall 22 of one of the handle portions 21 has inserted therein a dowel 25 and impailed on an exposed portion of the dowel 25 is a block of resilient material 26 on which is mounted the clapper 13.

The clapper 13 comprises a rod 27 one end of which is inserted in a wall of the resilient block 26 remote from the dowel 25. A remote end portion of the rod 27 carries a ball 28 of resilient material.

It will be appreciated that the handle 12 may be of a different configuration and may, for example, comprise leather or plastics straps.

The arrangement is such that grasping the handle 12 of the device 10 and carrying out a quick movement of the wrist, the ball 28 will strike an adjacent face of the plate 11 at a location adjacent mid—way along the long edge 20 with a result that a pleasant sound of comparable duration to that of a bell is produced.

The sound is produced by the action of the ball 28 striking the plate 11 and causing the plate to resonate. The effect is illustrated in FIG. 2 where the plate 11 is shown rectilinear as it is before being struck by the ball 28 and is also shown as a waveform as it is after having been struck and resonating, the waveform indicating shape of the plate 11 in cross section at an instant and showing flexure of the plate about nodal lines 29, 30. The nodal lines also are shown in FIG. 1.

It will be appreciated that the size of the plate 11 may be varied, provided the proportions specified above are observed. The larger the plate 11, the lower will be the pitch of the note sounded and the smaller the plate, the higher will be the pitch of the note sounded. Frequency being proportional to the inverse of the square of the dimension "a", if the dimension is halved and the dimensions "b" and "c" also are halved, the frequency will be quadrupled and directly proportional to thickness such that doubling the thickness doubles the frequency.

It will also be appreciated that small adjustments of the ratios specified above effect the decay rate of the sound and frequency of resonance.

The flexible block 26 has the effect of returning the clapper 13 to a neutral position after striking the plate 11 and is such that sideways movement is more restricted than is movement towards and away from the plate 11. However, a degree of sideways movement occurs thus allowing greater degree of control of sound dynamics.

It will be appreciated that an acoustic device in accordance with the present invention provides a percussive musical instrument comparable to a hand bell of similar dimension. However, the cost of manufacture would be considerably less than would be the cost of manufacture of the hand bell. In consequence, it is to be expected that devices in accordance with the present invention are more likely to be purchased in quantity than are hand bells.

It is possible, of course, to enhance the appearance of an acoustic device in accordance with the present invention by, for example, surface treating the plate 11 colour coding the handle and bending the plate.

It will be appreciated that, provided that the ratio of the dimensions is maintained and thickness of the plate increased proportionally, a larger version of the acoustic device in accordance with the invention could be used as a church bell, or orchestral bell simulating the sound of a church bell.

It will also be appreciated that an acoustic device in accordance with the present invention may be adapted for use other than as a musical instrument. For example, the plate 11 may be incorporated in an electrically operable bell or chimes system in a building. In such an example, resonance of the plate 11 could be achieved by creating a varying electromagnetic field to excite the plate 11.

I claim:

1. An Acoustic Device comprising a metal plate having a first location and a configuration expanding outwardly from the first location in a direction on opposite sides of a first axis extending through the first location, the configuration providing two diverging rectilinear edges of substantially equal length, each said length being a first dimension, and two substantially parallel rectilinear edges of substantially equal length remote from the first location, the substantially parallel edges being spaced one from another at a distance, being a second dimension, along a second axis at right angles to the first axis and crossing the first axis at a second location spaced a distance, being a third dimension, from the first location wherein the first and third dimensions are within a ratio of 0.75:1 and 1.25:1 and the first and second dimensions are within a ratio of 0.75:1 and 2.5:1 such that, when the plate is supported at least as far from the second location as the first location and is subjected to a stimulus, the plate resonates.

2. An Acoustic Device comprising a metal plate having a first location and a configuration expanding outwardly from the first location in a direction on opposite sides of a first axis extending through the first location, the configuration providing two divering rectilinear edges of substantially equal length, each said length being a first dimension, and two substantially parallel rectilinear edges of substantially equal length remote from the first location, the substantially parallel edges being spaced one from another at a distance, being a second dimension, along a second axis at right angles to the first axis and crossing the first axis at a second location spaced a distance, being a third dimension, from the first location wherein the first and third dimensions are within a ratio of 0.75:1 and 1.25:1 and the first and second dimensions are within a ratio of 0.75:1 and 2.5:1 such that, when the plate is supported at least as far from the second location as the first location and is subjected to a stimulus by means provided, the plate resonates.

3. An Acoustic Device comprising a metal plate having a first location and a configuration expanding outwardly from the first location in a direction on opposite sides of a first axis extending through the first location, the configuration providing two diverging rectilinear edges of substantially equal length, each said length being a first dimension, and two substantially parallel rectilinear edges of substantially equal length remote from the first location, the substantially parallel edges being spaced one from another at a distance, being a second dimension, along a second axis at right angles to the first axis and crossing the first axis at a second location spaced a distance, being a third dimension, from the first location wherein the first and third dimensions are within a ratio of 0.75:1 and 1.25:1 and the first and second dimensions are within a ratio of 0.75:1 and 2.5:1 such that, when the plate is supported at least as far from the second location as the first location and is subjected to a stimulus by means comprising of a clapper, the plate resonates.

4. An Acoustic Device comprising a metal plate having a first location and a configuration expanding outwardly from the first location in a direction on opposite sides of a first axis extending through the first location, the configuration providing two diverging rectilinear edges of substantially equal length, each said length being a first dimension, and two substantially parallel rectilinear edges of substantially equal length remote from the first location, the substantially parallel edges being spaced one from another at a distance, being a second dimension, along a second axis at right angles to the first axis and crossing the first axis at a second location spaced a distance, being a third dimension, from the first location wherein the first and third dimensions are within a ratio of 0.75:1 and 1.25:1 and the first and second dimensions are within a ratio of 0.75:1 and 2.5:1 such that, when the plate is supported at least as far from the second location as the first location and is subjected to a stimulus by means comprising of a clapper mounted at the first location, the plate resonates.

5. An Acoustic Device comprising a metal plate having a first location and a configuration expanding outwardly from the first location in a direction on opposite sides of a first axis extending through the first location, the configuration providing two diverging rectilinear edges of substantially equal length, each said length being a first dimension, and two substantially parallel rectilinear edges of substantially equal length remote from the first location, the substantially parallel edges being spaced one from another at a distance, being a second dimension, along a second axis at right angles to the first axis and crossing the first axis at a second location spaced a distance, being a third dimension, from the first location wherein the ratio of the first, second and third dimensions is 132:186:123 such that, when the plate is supported at least as far from the second location as the first location and is subjected to a stimulus, the plate resonates.

6. A device as claimed in claim 5 wherein the means of providing the stimulus is by way of a clapper which is mounted at the first location.

7. A device as claimed in claim 5 wherein the means of providing the stimulus is by way of a clapper which is mounted at the first location by means comprising a component of resilient material.

8. A device as claimed in claim 5 wherein the means of providing the stimulus is by way of a clapper which is mounted at the first location by means comprising a component of resilient material and said clapper comprises a component of resilient material.

* * * * *